US012090366B2

(12) United States Patent
Stegeman et al.

(10) Patent No.: US 12,090,366 B2
(45) Date of Patent: Sep. 17, 2024

(54) CLOSED-TOE SWIM FIN

(71) Applicants: Thomas T. Stegeman, Fort Myers, FL (US); John H. Schaumberg, Lebanon, IN (US)

(72) Inventors: Thomas T. Stegeman, Fort Myers, FL (US); John H. Schaumberg, Lebanon, IN (US)

( * ) Notice: Subject to any disclaimer, the term of this patent is extended or adjusted under 35 U.S.C. 154(b) by 0 days.

(21) Appl. No.: 18/227,824

(22) Filed: Jul. 28, 2023

(65) Prior Publication Data

US 2024/0165465 A1 May 23, 2024

Related U.S. Application Data

(60) Provisional application No. 63/426,246, filed on Nov. 17, 2022.

(51) Int. Cl.
*A63B 31/11* (2006.01)

(52) U.S. Cl.
CPC ..... *A63B 31/11* (2013.01)

(58) Field of Classification Search
CPC ..... A63B 31/11
See application file for complete search history.

(56) References Cited

U.S. PATENT DOCUMENTS

| | | | | |
|---|---|---|---|---|
| 2,903,719 | A | 9/1959 | Wozencraft | |
| D278,165 | S | 3/1985 | Evans | |
| 4,857,024 | A | 8/1989 | Evans | |
| D353,181 | S | 12/1994 | Evans | |
| 5,766,050 | A * | 6/1998 | Maggi | A63B 31/11 441/63 |
| D396,897 | S | 8/1998 | Evans | |
| 5,810,629 | A | 9/1998 | Parr | |
| 5,899,781 | A | 5/1999 | McLaughlin | |
| D427,270 | S | 6/2000 | Harwell, IV et al. | |
| D430,637 | S | 9/2000 | Evans | |
| D450,365 | S | 11/2001 | Evans | |
| 6,354,894 | B1 | 3/2002 | Evans | |
| 7,854,638 | B2 | 12/2010 | Twombly | |
| 8,257,124 | B2 | 9/2012 | Garofalo et al. | |
| 8,986,061 | B2 | 3/2015 | Fraser | |
| D819,154 | S | 5/2018 | Fraser | |

(Continued)

FOREIGN PATENT DOCUMENTS

KR 101712751 B1 * 3/2017

OTHER PUBLICATIONS

Languna Fin Co., https://lagunafin.com/ [Date accessed: Aug. 10, 2022].

(Continued)

*Primary Examiner* — Anthony D Wiest
(74) *Attorney, Agent, or Firm* — Bold IP PLLC

(57) ABSTRACT

A closed-toe swim fin device. The swim fin includes a rear cavity designed to receive the front portion of a user's foot, e.g., the portion in front of the ankle, and to hold the user's foot therein via vacuum seal, friction, and pressure fit. The swim fin is otherwise sealed and fluid-tight such that the only way into and out of the rear cavity is through the rear cavity's opening that receives the user's foot. In this way, the swim fin eliminates the need for other types of foot attachment mechanisms (e.g., shoes, heel straps) thereby reducing the resulting water drag of the fin when in use.

17 Claims, 5 Drawing Sheets

(56) References Cited

U.S. PATENT DOCUMENTS

| | | | |
|---|---|---|---|
| 2004/0209534 | A1 | 10/2004 | Graham |
| 2005/0215137 | A1 | 9/2005 | Vassallo |
| 2019/0201745 | A1 | 7/2019 | McCarthy |

OTHER PUBLICATIONS

"ZOOMERS® Gold", finisswim.com. https://www.finisswim.com/Zoomer-Gold [Date accessed: Aug. 10, 2022].
"Z2 Gold ZOOMERS®", finisswim.com. https://www.finisswim.com/Z2-Gold [Date accessed: Aug. 10, 2022].
"Speedo Power Fins", recreonics.com. https://www.recreonics.com/product/speedo-power-fins/ [Date accessed: Aug. 10, 2022].
International Search Report for international application No. PCT/US23/29698, Oct. 10, 2023.
Written Opinion of the International Searching Authority for international application No. PCT/US23/29698, Oct. 10, 2023.

* cited by examiner

CLOSED-TOE SWIM FIN

CROSS-REFERENCE TO RELATED APPLICATIONS

This application claims priority to U.S. Provisional Application No. 63/426,246 filed Nov. 17, 2022, the entire contents of which are hereby fully incorporated herein by reference for all purposes.

FIELD OF THE INVENTION

The present invention belongs to the field of swimming equipment, including a closed-toe swim fin.

BACKGROUND

Swim fins are used by swimmers throughout the world to increase their propulsion while swimming through the water. A swimmer may typically use a first swim fin attached to his/her left foot and a second swim fin attached to his/her right foot.

However, swim fins currently available require bulky mechanisms to attach the fins to the user's feet. For example, some swim fins include a shoe portion that receives the entire foot from the toes to the heel. In this case, each swim fin must be sized to properly fit the size of the user's feet. In another example, some swim fins include adjustable heel straps that extend around the back of the user's heel to hold the user's foot in place. However, these heel strap mechanisms are often difficult to adjust, add bulk and water drag to the swim fins, and are uncomfortable and oftentimes cause abrasions and blisters. In addition, for competitive swimmers who wish to use swim fins during training, traditional swim fins using shoe or strap style designs hinder the swimmer's ability to perform flip turns.

Accordingly, there is a need for a swim fin that does not require a shoe portion or a heel strap to attach the swim fin to a user's foot.

SUMMARY

According to one aspect, one or more embodiments are provided below for a swim fin comprising a foot holding portion including a fluid-tight cavity with a single cavity opening adapted to receive a portion of a user's foot; and a fin portion coupled to the foot holding portion; wherein the fluid-tight cavity provides a vacuum seal about a user's foot when the user's foot is placed within the foot holding portion.

In another embodiment, the single cavity opening includes an upper side with a first radius of curvature and a lower side with a second radius of curvature, and the first radius of curvature is less than the second radius of curvature.

In another embodiment, the single cavity opening includes a left side and a right side and the left side generally mirrors the right side.

In another embodiment, the single cavity opening is formed as a rectangle with rounded corners.

In another embodiment, a first width of the cavity at the single cavity opening is less than a second width of the cavity at a location in the cavity generally opposite the single cavity opening.

In another embodiment, the foot holding portion is comprised of an elastomer.

In another embodiment, the swim fin further comprises a left rib configured with a left side of the foot holding portion and with a left side of the fin portion, and a right rib configured with a right side of the foot holding portion and with a right side of the fin portion.

In another embodiment, the left rib is separated from the left side of the foot holding portion by a left side section thereby forming a left gap between the left rib and the left side of the foot holding portion, and/or wherein the right rib is separated from the right side of the foot holding portion by a right side section thereby forming a right gap between the right rib and the right side of the foot holding portion.

In another embodiment, the left side of the foot holding portion is adapted to expand into the left gap when a user's foot is placed into the single cavity opening, and/or the right side of the foot holding portion is adapted to expand into the right gap when a user's foot is placed into the single cavity opening.

In another embodiment, a width of the left gap and/or of the right gap is about 1.0 mm to 5.0 mm.

In another embodiment, the left rib includes a left rib height, and the right rib includes a right rib height, and the left rib height and/or the right rib height is greater than a thickness of the fin portion.

In another embodiment, the left rib includes a left rib proximal end with a left rib proximal height and a left fin distal end with a left rib distal height, and the left fin proximal height is greater than the left rib distal height, and/or wherein the right rib includes a right rib proximal end with a right rib proximal height and a right fin distal end with a right rib distal height, and the right fin proximal height is greater than the right rib distal height.

In another embodiment, the swim further comprises a tab configured with the single cavity opening for grasping and expanding the single cavity opening.

According to another aspect, one or more embodiments are provided below for a swim fin comprising a foot holding portion including a fluid-tight cavity with a single cavity opening adapted to receive a portion of a user's foot; a fin portion coupled to the foot holding portion; and a left rib configured with a left side of the foot holding portion and with a left side of the fin portion and separated from the left side of the foot holding portion by a left gap, and a right rib configured with a right side of the foot holding portion and with a right side of the fin portion and separated from the right side of the foot holding portion by a right gap; wherein the fluid-tight cavity provides a vacuum seal about a user's foot when the user's foot is placed within the foot holding portion.

Other aspects and advantages of the invention will be apparent from the following description and the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, and according to exemplary embodiments hereof, a swim fin device is provided. The swim fin includes a rear cavity designed to receive the front portion of a user's foot, e.g., the portion in front of the ankle, and to hold the user's foot therein via vacuum seal, friction, and pressure fit. The portion of the swim fin defining the cavity includes an elastic material that allows the user to expand the cavity opening in order to insert his/her foot. Once the user's foot is inserted, the user squeezes out any water or air from within the cavity, setting up a vacuum within the cavity that holds the foot therein until intentionally removed. Friction between the fin and the user's foot also holds the foot secure. In this way, the swim fin eliminates the need for other types of foot attachment mechanisms (e.g., shoes, heel straps) thereby reducing the resulting water drag of the fin when in use.

Figure 1:
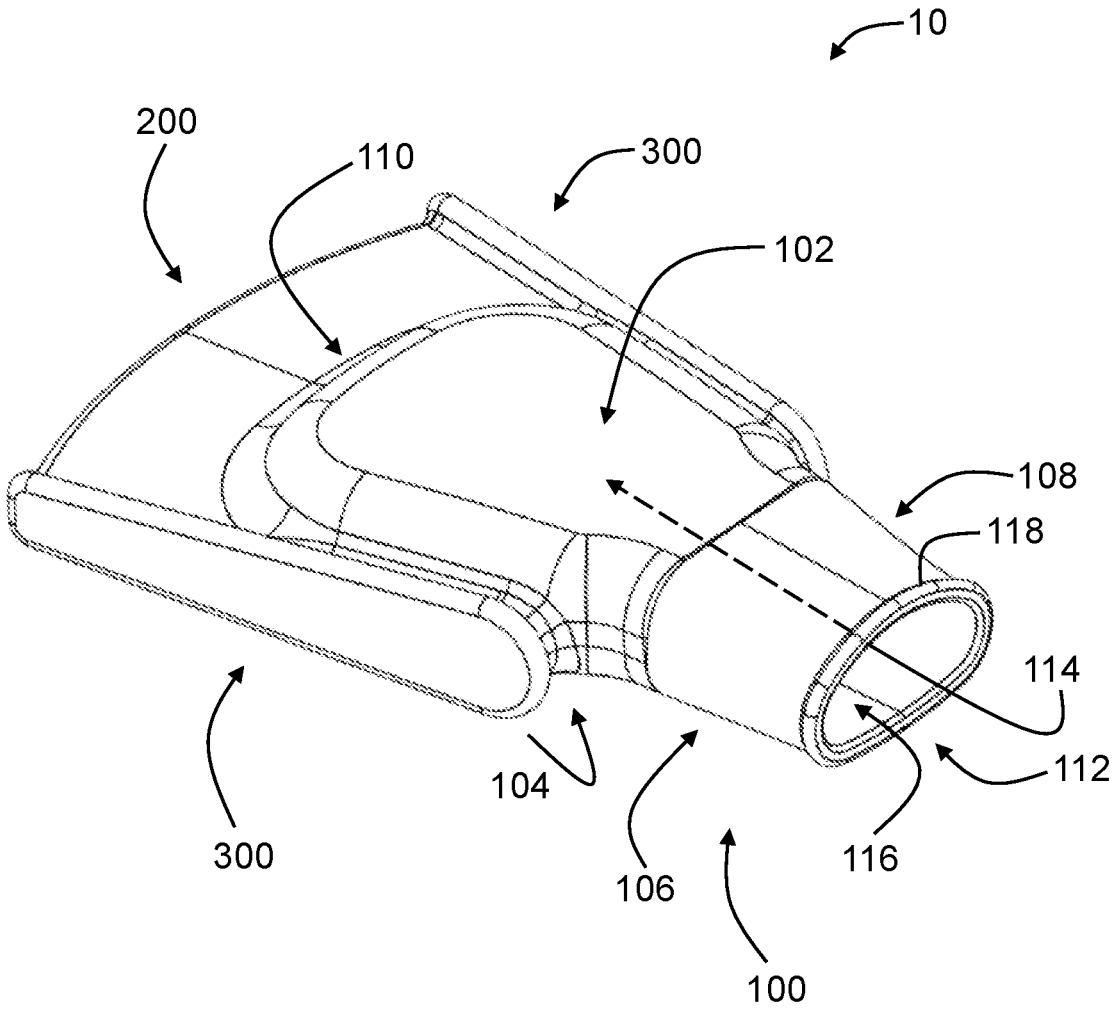
FIG. 1 shows a schematic of a swim fin in accordance with exemplary embodiments hereof.
Figure 2:
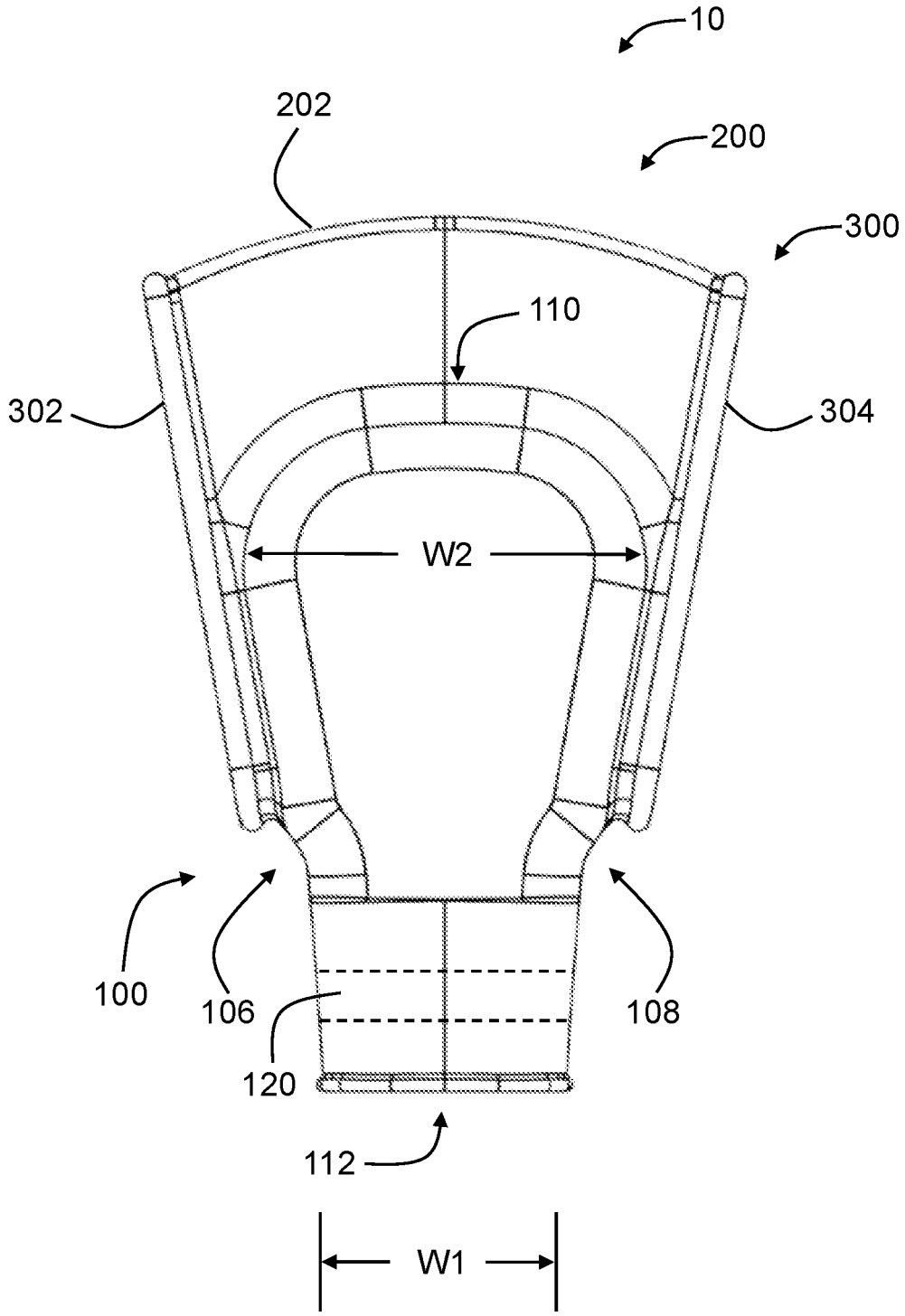
FIG. 2 shows a top view of the swim fin of FIG. 1 in accordance with exemplary embodiments hereof.
Figure 3:
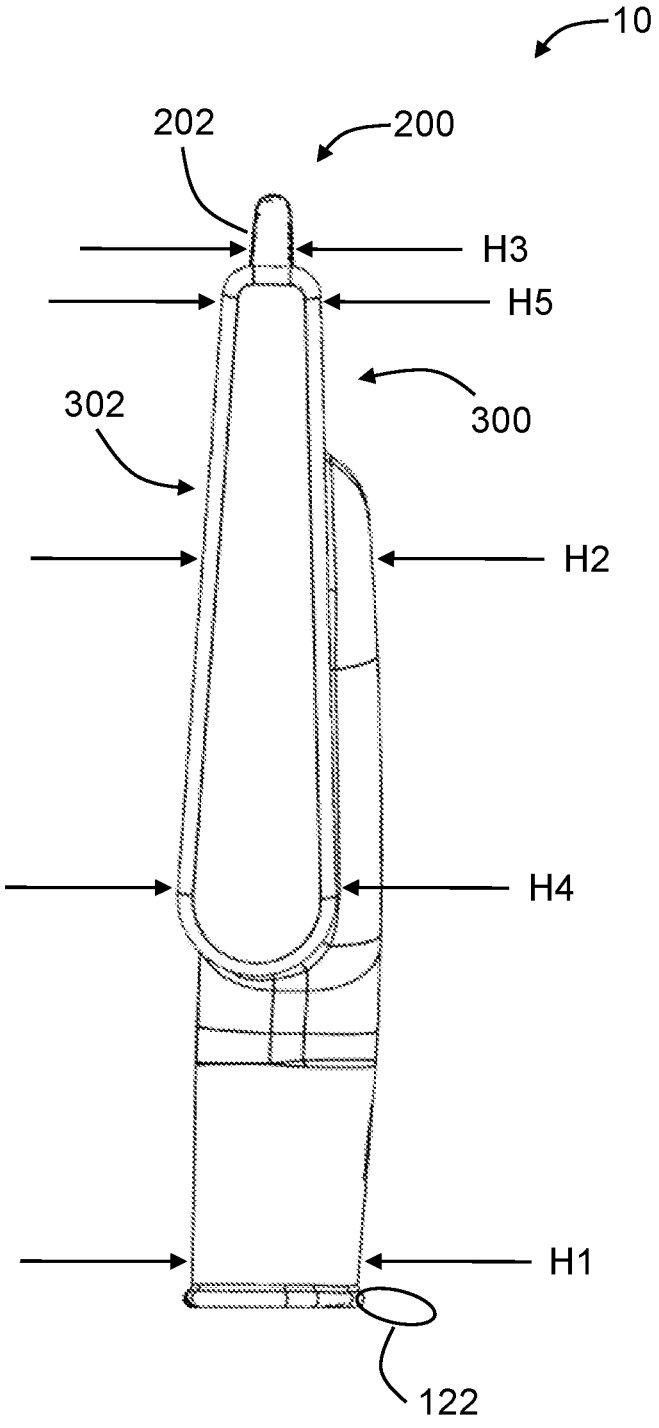
FIG. 3 shows a side view of the swim fin of FIG. 1 in accordance with exemplary embodiments hereof.
Figure 4:
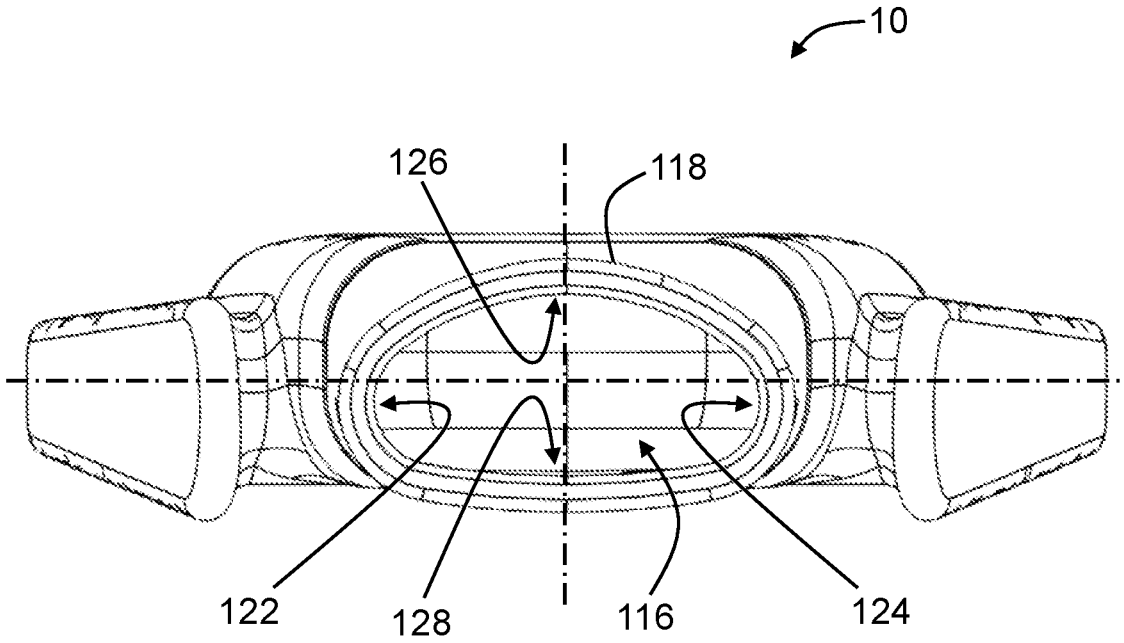
FIG. 4 shows a rear view of the swim fin of FIG. 1 in accordance with exemplary embodiments hereof.

FIG. 1 shows an isotropic view of the swim fin device 10 (also referred to herein as simply the device 10) according to exemplary embodiments hereof. FIG. 2 shows a top view of the device 10. FIG. 3 shows a side view of the device 10, and FIG. 4 shows a front view of the device 10.

In some embodiments, as shown in FIG. 1, the device 10 includes a foot holding portion 100, a fin section 200, and reinforcement structures 300.

In general, a user places his/her left foot into the foot holding portion 100 of a first swim fin device 10 to releasably secure the first swim fin device 10 to his/her left foot, and his/her right foot into the foot holding portion 100 of a second swim fin device 10 to releasably secure the second swim fin device 10 to his/her right foot. As will be described herein, a vacuum is created about each foot and its corresponding foot holding portion 100, thereby holding each foot in place. Once secured, the user may swim with the devices 10 secured to his/her feet while utilizing the fin sections 200 for propulsion. The reinforcement structures 300 provide support to the fin sections 200 as well as structural guidance to water passing over the fin sections 200 during use.

For the purposes of this specification, a single swim fin device 10 will be described in detail. However, it is understood that a user may utilize two swim fin devices 10, e.g., one on his/her left foot and one on his/her right foot, during use, and in such cases, the left and right swim fins 10 may be provided to the user as a pair. Accordingly, unless specified otherwise, the details provided herein may apply to both a left foot version of the device 10 and a right foot version of the device 10.

In some embodiments, a left swim fin device 10 may be identical to a right swim fin device 10 such that the swim fin device 10 may fit onto either the left foot or the right foot. In other embodiments, the left swim fin device 10 may be specifically tailored to fit onto a left foot of a user and the right swim fin device 10 may be specifically tailored to fit a right foot of a user.

In some embodiments, as shown in FIG. 1, the foot holding portion 100 includes a top 102, a bottom 104, a left side 106, a right side 108, a front 110, and a rear 112 thereby defining an inner volume 114. The rear 112 includes an opening 116 to receive a user's foot and is generally defined by its circumferential rim 118.

In some embodiments, as shown in FIG. 1, the inner volume 112 is formed as a fluid-tight cavity. The inner volume 112 terminates at the front 110 of the foot holding portion 100 such that the only way into and out of the cavity is through the opening 116. As will be described in other sections, this provides a vacuum seal about the user's foot when the foot is placed into the inner volume 112 for use of the device 10.

In some embodiments, as shown in FIGS. 2-3, the foot holding portion 100 includes a first width W1 and a first height H1 at or near the opening 116 and a second width W2 and a second height H2 towards its front 110. In some embodiments, the first width W1 and first height H1 are preferably chosen to be slightly smaller than an approximate width and height of a user's foot at a proximal position of the foot directly in front of the foot's ankle, and the second width W2 and height H2 are chosen to generally match an approximate width and height of the user's foot at a distal position of the foot towards the foot's toe area. In this way, when the user's foot is placed into the inner volume 114, the foot may fit comfortably and snugly therein. As shown in FIG. 2, in some embodiments, the first width W1 may be generally smaller than the second width W2 (i.e., W1<W2).

In addition, in some embodiments, as shown in FIGS. 2-3, the first width W1 is generally larger than the first height H1 such that the opening 116 is wider than it is tall. In this way, the opening 116 is shaped to receive a user's foot that also may be wider than it is tall. In some embodiments, given the above, the opening 116 may be formed as a sideways rectangle with rounded corners (see FIG. 1), as a sideways oval, and/or as other suitable shapes.

In some embodiments, as shown in FIG. 4, the fin's rear opening 116 generally includes a left side 122, a right side 124, an upper side 126, and a lower side 128. In some embodiments, the upper side 126 includes a curvature that is sharper than the curvature of the lower side 128. Put another way, the upper side 126 may include a smaller radius of curvature than the radius of curvature of the lower side 128. In some embodiments, the curvature of the left side 122 may generally match and mirror the curvature of the right side 124. In this way, the overall shape of the opening 116 may generally resemble the cross-sectional shape of a user's foot such that the opening 116 may form fit around the user's foot upon placement of the foot within the opening 116. This form fitting may facilitate the vacuum seal that secures the fin device 10 to the user's foot as described herein.

In some embodiments, the foot holding portion 100 comprises material(s) that provide adequate elastic and flexibility characteristics so that the foot holding portion 100 may stretch, bend, flex, and/or otherwise change its shape to accommodate the shape of the user's foot portion that is received into the portion's 100's inner volume 114. The materials also are preferably chosen to be nonporous and impermeable. For example, the foot holding portion 100 may preferably comprise rubber (natural and/or synthetic), other suitable elastomers, other suitable materials, and any combinations thereof. In some embodiments, the fin section 200 and/or the reinforcement structures 300 may comprise a material that is more rigid than the foot holding portion 100, e.g., a rubber and/or plastic that is harder and/or more rigid than the material forming the foot holding portion 100. However, this may not be necessary.

Given the above, it may be preferable that the material used to form the swim fin 10 have an elasticity of about 300%-800%, and preferably about 400%-700%. In some embodiments, the material used to form the foot holding portion 100 may have an elasticity that is greater than the material used to form the reinforcement structures 300. For example, in some embodiments, the material used to form the foot holding portion 100 may have an elasticity of about 600%-650%, and preferably about 620%, and the material used to form the reinforcement structures 300 may have an elasticity of about 400%-450%, and preferably about 420%. In addition, the material used to form the foot holding portion 100 may have a hardness of about Shore 10A and the material used to form the reinforcement structures 300 may have a hardness of about Shore 40A. Other elasticity and/or hardness specifications also may be used.

In some embodiments, as shown in FIG. 2, the foot holding portion 100 may include a vacuum band 120 that generally extends about the inner circumference of the foot holding portion 100 (or at least a portion thereof) within the inner volume 114. It also is appreciated that the vacuum band 120 may extend within the material that forms the foot holding portion 100, may extend about the outer circumference of the foot holding portion 100, and/or any combinations thereof. In some embodiments, the vacuum band 120 may be formed of a material that has a slightly lower elasticity than the material used to generally form the foot holding portion 100. In this way, the vacuum band 120 may provide a ring of material about the user's foot that is tighter than the other portions of the foot holding portion 100, and as such, may help to ensure that the vacuum seal about the user's foot is adequate to hold the swim fin 10 in place when worn. In some embodiments, it may be preferable that the vacuum band 120 extend within a plane that is generally perpendicular to a longitudinal axis of the foot holding portion 100 as defined by the foot holding portion's 100's front 110 and rear 112 ends. However, it is understood that the vacuum band 120 may extend in any suitable orientation with respect to the foot holding portion 100. In some embodiments, the foot portion's 100's circumferential rim 118 also may serve as a vacuum band 120.

In some embodiments, as shown in FIG. 2, the fin section 200 includes a blade 202 that extends outward from the front 110 and sides 106, 108 of the foot holding portion 100. In some embodiments, the blade 202 preferably extends generally in the same plane as the foot holding portion 100. In some embodiments, the blade 202 extends forward from the front 110 of the foot holding portion 100 a distance chosen to provide adequate fin surface area for water movement and propulsion. For example, the blade 202 may extend about 1"-20" beyond the front 110 of the foot holding portion 100, and preferably about 1"-14", and more preferably about 1"-10", and more preferably about 1"-6" beyond the front 110 of the foot holding portion 100.

In some embodiments, as shown in FIG. 2, the blade 202 may fan outward laterally to the left and/or to the right such that the width of the blade 202 at its distal end may be greater than the width of the blade 202 at its proximal end. The amount of outward fanning may be chosen to provide adequate fin surface area for water movement and propulsion while maintaining comfortable use of the device 10.

In some embodiments, as shown in FIGS. 2-3, the reinforcement structures 300 include a left rib 302 and a right rib 304. The left rib 302 may be generally configured with the left side of the blade 202 and may generally extend the entire length (or at least a portion thereof) of the blade's 202's left side. Similarly, the right rib 304 may be generally configured with the right side of the blade 202 and may generally extend the entire length (or at least a portion thereof) of the blade's 202's right side. In some embodiments, the reinforcement ribs 302, 304 are generally orthogonal to the fin's blade 202, and as such, may provide stiffness and front-to-back support of the fin's blade 202.

In addition, also as shown in FIG. 3, the heights H4 and H5 of the ribs 302, 304 may preferably be larger than the height H3 (i.e., the thickness) of the fin's blade 202. In this way, the left and right ribs 302, 304, acting as sidewalls to the fin's blade 202, may form an upper channel on the upper surface of the fin's blade 202 between the ribs 302, 304 and an underneath channel on the underneath surface of the fin's blade 202 between the ribs 302, 304. The upper and lower channels may generally guide the water in a forward direction as it flows over the fin's blade 202 during use of the fin device 10 for propulsion.

In some embodiments, as shown in FIG. 3, the height H4 of the left and right ribs 302, 304 (note that only the left rib 302 is shown in FIG. 3 with the right rib 304 obstructed from view) at their proximal ends may be larger than the height H5 at their distal ends. However, this may not be necessary.

Figure 5:
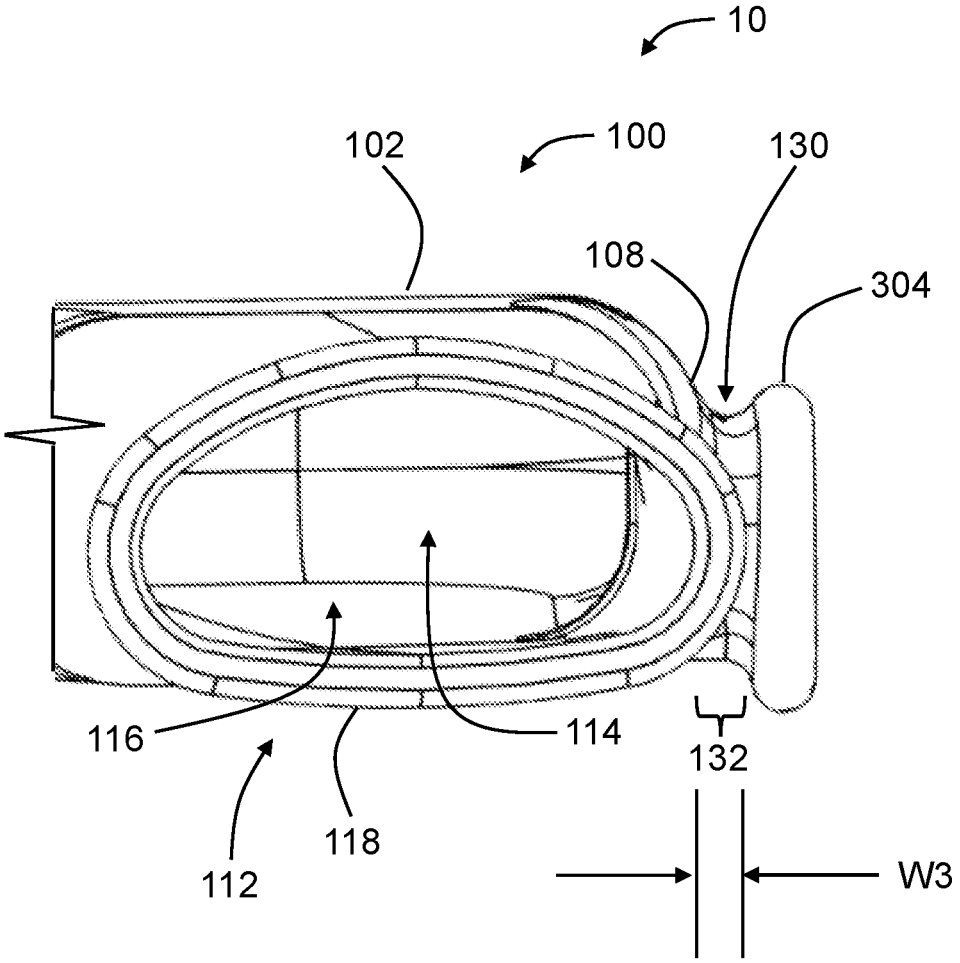
FIG. 5 shows aspects of a swim fin in accordance with exemplary embodiments hereof.

FIG. 5 shows a rear view of the swim fin device 10 looking directly into the rear of the right rib 304 and FIG. 2 shows a top view of the swim fin device 10. The left portion of the swim fin 10 has been omitted in FIG. 5 to provide adequate room for the figure. In some embodiments, as shown in FIG. 2, the right rib 304 extends along a portion of the right side 108 of the foot holding portion 100. In some embodiments, as shown in FIG. 5, the right rib 304 is separated from the foot holding portion's 100's right side 108 by a side section 130 that extends from the foot holding portion's 100's right side 108 to the right rib 304. This forms a gap 132 of width W3 between the foot holding portion's 100's right side 108 and the right rib 304 that allows for the expansion of the foot holding portion 100 to the right as the user may place his/her foot through the rear opening 116 and into the inner volume 114. That is, as the user places his/her foot into the opening 116, the foot holding portion 100 may expand to the right and into the gap 132 thereby enabling the foot holding portion 100 to form fit to the user's foot. In some embodiments, the width W3 of the gap 132, as shown in FIG. 5 is about 1.0 mm to about 20.0 mm, and preferably about 1.0 mm to about 10.0 mm, and more preferably about 1.0 mm to about 5.0 mm. It is understood that a similar side section and resulting gap may exist at the foot holding portion's 100's left side 106 between the left side 106 and the left rib 302 for the same purposes and functionalities. This structure and resulting functionality also may enable a swim fin device 10 to fit a variety of different sized feet due to its ability to expand.

In use, a user may place his/her toes at the entrance to the foot holding portion's 100's opening 116 near the rear 112 of the swim fin 10 and then slide his/her foot through the opening 116 and into the foot holding portion's 100's inner volume 114. During this motion, the foot holding portion's 100's top 102, bottom 104, left side 106, right side 108, and opening 116 may stretch, bend, flex, and/or otherwise change shape to accommodate the user's foot within the inner volume 114.

Once placed on the user's foot, it is preferable that the opening's 116's circumferential rim 118 be stretched around the circumference of the user's foot at a location in front of the foot's ankle, e.g., about halfway between the ankle and the "ball" of the foot. It also may be preferable that the seal between the opening 116 and the user's foot be fluid-tight (e.g., watertight, and airtight). In this way, a vacuum seal is created between the foot holding portion 100 and the user's foot thereby holding the swim fin device 10 on the user's foot. Friction and pressure fit between the surfaces of the inner volume 114 and the user's foot also add to the holding of the foot within the device 10.

In some embodiments, it may be preferable that the user place the swim fin device 10 on his/her foot while in the water. Once this is accomplished, it also may be preferable that the user squeeze the foot holding portion 100 (e.g., by grasping the holding portion's sides 106, 108 and/or top 102 and bottom 104 and squeezing) to force any air and/or water that may be trapped in the inner volume 114 out the opening 116. Accordingly, this may increase the vacuum seal applied between the foot holding portion 100 and the user's foot.

Once the user has placed a left swim fin device 10 on his/her left foot and a right swim fin device 10 on his/her right foot, the user may swim with the devices 10 in place while utilizing the fin sections 200 for propulsion. The vacuum seal formed between each foot and its corresponding foot holding portion's 100's inner volume 114, and the friction and pressure fit created thereby, effectively holds the swim fin devices 10 in place during use.

To remove a swim fin device 10, the user may grasp the device's 10's opening's 116's circumferential rim 118 and pull outward, thereby releasing the vacuum seal and allowing the foot to be removed. In some embodiments, to facilitate this action, the circumferential rim 118 (and/or another suitable location on the rear 112 of the fin device 10) may include a tab 122 or a raised portion that the user may easily grasp and pull (see FIG. 3).

Advantageously, the fin device 10 may be extremely useful for training competitive swimmers and provide a better fin device 10 that does not include complicated and bulky fastening systems to the foot which are currently used by traditional swim fins. Notably, the fin device 10 is one piece and structurally conforms to the user's foot that works via friction fit similar to a sock or glove and does not require a strap or other fastening mechanism. Further, the fin device 10 is closed in front 110 and only open in the rear 112 of the fin device 10. In this way, the swim fin eliminates the need for other types of foot attachment mechanisms (e.g., shoes, heel straps) thereby reducing the resulting water drag of the fin when in use.

It is understood that any aspect or element of any embodiment(s) of the device 10 may be combined with any other aspect or element of any other embodiment(s) of the device 10 to form additional embodiments of the device 10 all of which are within the scope of the device 10.

Where a process is described herein, those of ordinary skill in the art will appreciate that the process may operate without any user intervention. In another embodiment, the process includes some human intervention (e.g., a step is performed by or with the assistance of a human).

As used in this description, the term "portion" means some or all. So, for example, "A portion of X" may include some of "X" or all of "X". In the context of a conversation, the term "portion" means some or all of the conversation.

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y" Thus, as used herein, including in the claims, the phrase "X is distinct from Y" means that X differs from Y in at least some way.

As used herein, including in the claims, a list may include only one item, and, unless otherwise stated, a list of multiple items need not be ordered in any particular manner. A list may include duplicate items. For example, as used herein, the phrase "a list of XYZs" may include one or more "XYZs".

It should be appreciated that the words "first" and "second" in the description and claims are used to distinguish or identify, and not to show a serial or numerical limitation. Similarly, the use of letter or numerical labels (such as "(a)", "(b)", and the like) are used to help distinguish and/or identify, and not to show any serial or numerical limitation or ordering.

No ordering is implied by any of the labeled boxes in any of the flow diagrams unless specifically shown and stated. When disconnected boxes are shown in a diagram the activities associated with those boxes may be performed in any order, including fully or partially in parallel.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A swim fin comprising:

a foot holding portion including a proximal end and a distal end and a cavity with a single cavity opening located at the proximal end, the foot holding portion adapted to receive a portion of a user's foot through the single cavity opening and into the single cavity; and a fin portion coupled to the foot holding portion;

wherein a length of the foot holding portion between the proximal end and the distal end is chosen to place the single cavity opening at a first location on the user's foot about midway between an ankle and a ball of the user's foot when the user's foot is received into the single cavity;

wherein the cavity secures the user's foot to the swim fin by providing a vacuum seal about the user's foot when the user's foot is received into the single cavity; and wherein the swim fin includes no foot attachment mechanisms other than the cavity to secure the user's foot to the swim fin when worn.

2. The swim fin of claim 1 wherein the single cavity opening includes an upper side with a first radius of curvature and a lower side with a second radius of curvature, and the first radius of curvature is less than the second radius of curvature.

3. The swim fin of claim 1 wherein the single cavity opening includes a left side and a right side and the left side generally mirrors the right side.

4. The swim fin of claim 1 wherein the single cavity opening is formed as a rectangle with rounded corners.

5. The swim fin of claim 1 wherein a first width of the cavity at the single cavity opening is less than a second width of the cavity at a location in the cavity generally opposite the single cavity opening.

6. The swim fin of claim 1 wherein the foot holding portion is comprised of an elastomer.

7. The swim fin of claim 1 further comprising:

a left rib configured with a left side of the foot holding portion and with a left side of the fin portion, and a right rib configured with a right side of the foot holding portion and with a right side of the fin portion.

8. The swim fin of claim 7 wherein the left rib is separated from the left side of the foot holding portion by a left side section and/or wherein the right rib is separated from the right side of the foot holding portion by a right side section.

9. The swim fin of claim 7 wherein the left rib includes a left rib height, and the right rib includes a right rib height, and the left rib height and/or the right rib height is greater than a thickness of the fin portion.

10. The swim fin of claim 7 wherein the left rib includes a left rib proximal end with a left rib proximal height and a left fin distal end with a left rib distal height, and the left fin proximal height is greater than the left rib distal height, and/or wherein the right rib includes a right rib proximal end with a right rib proximal height and a right fin distal end with a right rib distal height, and the right fin proximal height is greater than the right rib distal height.

11. The swim fin of claim 1 further comprising a tab configured with the single cavity opening for grasping and expanding the single cavity opening.

12. The swim fin of claim 1 wherein the single cavity opening is entirely defined by a closed loop contained within a single plane.

13. The swim fin of claim 1 wherein the single cavity opening includes a cavity opening circumference, the swim fin further comprising:

a vacuum band configured about the cavity opening circumference.

14. A swim fin comprising:

a foot holding portion including a proximal end and a distal end and a cavity with a single cavity opening located at the proximal end, the foot holding portion adapted to receive a portion of a user's foot through the single cavity opening and into the single cavity; and a fin portion coupled to the foot holding portion;

wherein a length of the foot holding portion between the proximal end and the distal end is chosen to place the single cavity opening at a first location on the user's foot about midway between an ankle and a ball of the user's foot when the user's foot is received into the single cavity;

wherein the single cavity opening is entirely defined by a closed loop contained within a single plane;

wherein the cavity secures the user's foot to the swim fin by providing a vacuum seal about the user's foot when the user's foot is received into the single cavity; and wherein the swim fin includes no foot attachment mechanisms other than the cavity to secure the user's foot to the swim fin when worn.

15. The swim fin of claim 14 wherein the single cavity opening includes an upper side with a first radius of curvature and a lower side with a second radius of curvature, and the first radius of curvature is less than the second radius of curvature.

16. The swim fin of claim 14 wherein the single cavity opening includes a left side and a right side and the left side generally mirrors the right side.

17. The swim fin of claim 14 wherein the single cavity opening includes a cavity opening circumference, the swim fin further comprising:

a vacuum band configured about the cavity opening circumference.

* * * * *